US006593050B2

(12) United States Patent
Katagiri et al.

(10) Patent No.: US 6,593,050 B2
(45) Date of Patent: Jul. 15, 2003

(54) FLASH FIXING COLOR TONER

(75) Inventors: Yoshimichi Katagiri, Kawasaki (JP); Yasushige Nakamura, Kawasaki (JP); Shinichi Yaoi, Kawasaki (JP)

(73) Assignee: Fuji Xerox, Co., Ltd., Tokyo (JP)

( * ) Notice: Subject to any disclaimer, the term of this patent is extended or adjusted under 35 U.S.C. 154(b) by 0 days.

(21) Appl. No.: 09/867,640

(22) Filed: May 31, 2001

(65) Prior Publication Data

US 2002/0106571 A1 Aug. 8, 2002

(30) Foreign Application Priority Data

Dec. 13, 2000 (JP) ..... 2000-379343

(51) Int. Cl.[7] ..... G03G 9/09; G03G 13/20

(52) U.S. Cl. ..... 430/108.23; 430/108.1; 430/108.21; 430/108.24; 430/108.6; 430/124

(58) Field of Search ..... 430/108.1, 108.21, 430/108.23, 108.2, 108.24, 97, 124, 106, 110, 108.6

(56) References Cited

U.S. PATENT DOCUMENTS 4,229,512 A * 10/1980 Lenhard et al. ..... 430/108.21
4,373,131 A * 2/1983 Lu ..... 430/124
4,699,863 A 10/1987 Sawatari et al.
5,582,950 A 12/1996 Katagiri et al.
5,597,673 A * 1/1997 Watanabe et al. ..... 430/108.24

FOREIGN PATENT DOCUMENTS

| | | |
|---|---|---|
| EP | 0892312 A2 | 1/1999 |
| JP | 56-81876 | 7/1981 |
| JP | 60-57858 | 4/1985 |
| JP | 61-132959 | 6/1986 |
| JP | 5-72817 | 3/1993 |
| JP | 7-191492 | 7/1995 |
| JP | 9-179347 | 7/1997 |
| JP | 9-329912 | 12/1997 |
| JP | 10-39535 | 2/1998 |
| JP | 11-38667 | 2/1999 |

* cited by examiner

*Primary Examiner*—Janis L. Dote
(74) *Attorney, Agent, or Firm*—Armstrong, Westerman & Hattori, LLP

(57) ABSTRACT

A flash fixing color toner for use in an image forming process includes a binder resin and a hue-altering coloring agent, wherein the hue-altering coloring agent alters, at a time of irradiation of flash light, an initial hue of the color toner into a secondary hue, so that the color toner is fixed to a recording medium by the irradiation of flash light, and a color image is substantially formed with the secondary hue of the color toner.

9 Claims, 1 Drawing Sheet

FLASH FIXING COLOR TONER

BACKGROUND OF THE INVENTION

1. Field of The Invention

The present invention generally relates to a flash fixing color toner that is used with an electrophotographic image forming process which is used by an electrophotographic copier, facsimile or printer, and more particularly to a flash fixing color toner which is appropriately fixed onto a recording medium by irradiation with flash light in an electrophotographic image forming process.

2. Description of The Related Art

In an electrophotographic image forming apparatus that employs flash light irradiation for fixing a toner onto a recording medium, the application of pressure to the toner is not needed for the fixing of the toner but it is necessary to make efficient use of the energy of flash light in the fixing or fusing of the toner onto the recording medium.

Generally, a color toner absorbs only part of an irradiation light energy, apart from a black toner. It has been observed that the light energy absorption properties of a color toner are lower than the light energy absorption properties of a black toner, and that the use of a color toner in a conventional flash fixation process often causes a defective fixing. However, in recent years, there is an increasing demand for a color image formation using an electrophotographic flash fixation process, which is capable of performing a high-speed operation and usable with a special recording medium having a step-like surface.

There are basically five major steps employed in the electrophotographic printing process: (1) charging a photoconductor electrostatically, (2) exposing the photoconductor to the imaging light pattern to create an electrostatic latent image thereon, (3) developing the photoconductor by bringing charged toner particles to the surface of the photoconductor to create a toner image thereon, (4) transferring the toner image from the photoconductor surface to a recording medium (e.g., paper), and (5) fixing or fusing the toner to the recording medium.

As is well known, among these steps of the electrophotographic printing process, the toner fixing step may be achieved by selecting one of the three methods: the heat roll method, the oven fixing method and the flash fixing method. The flash fixing method uses irradiation of light or infrared rays (flash light).

The heat roll method mentioned above is most commonly utilized. In the heat roll method, the fixing roller held at a high temperature applies heat and pressure directly to the toner so that the toner is fixed to the recording medium. With a simple, inexpensive configuration of the fixing roller used, the fixing surface can be made flat. However, there are several problems with the heat roll method. The recording medium (e.g., paper) after the toner fixing step is liable to be curled. The toner sticks to the surface of the fixing roller, and the recording medium is liable to being stained with such toner due to the offset. The recording medium and the fixing roller contact each other, and the transport of the recording medium in an image forming apparatus may be slanted from the desired direction. It is difficult to achieve high-speed image formation with the image forming apparatus. It is difficult that the heat roll method achieves the toner fixing of a special recording medium like a sticker post card.

The flash fixing method mentioned above is a non-contact toner fixing method, and the problems of the heat roller method such as the curling and the offset are eliminated. The high-speed image formation and the toner fixing of a special recording medium can easily be achieved with the flash fixing method. Accordingly, the application of the flash fixing method to high-speed printers and copiers for office use are increasing in recent years.

In the flash fixing method, a black toner or the like efficiently absorbs an irradiation light energy with respect to all the wavelengths. A thermal energy produced by irradiation of flash light will easily increase the temperature of the black toner to about 200 deg. C., and the particles of the black toner can be fused without difficulty. The toner fixing to the recording medium can easily be achieved in the case of the black toner or the like. However, as described above, the light energy absorption properties of a color toner are lower than the light energy absorption properties of a black toner, and the use of a color toner in the conventional flash fixation process often causes a defective fixing. For example, a thermal energy produced by irradiation of flash light can increase the temperature of the color toner to 100 deg. C. at the highest, and the particles of the color toner cannot easily be fused. The toner fixing to the recording medium cannot easily be achieved in the case of the color toner. The use of a color toner in the conventional flash fixation process is likely to cause a defective fixing.

As disclosed in Japanese Patent Nos.1602417 and 1820258, the inclusion of an infrared absorbent in a flash fixing color toner has been proposed in order eliminate the above problem. However, the infrared absorbent generally is expensive. As disclosed in Japanese Patent No.3022110, the infrared absorbent is a coloring agent which affects the resulting color image, and the use of the infrared absorbent imposes restrictions in many cases. Hence, it has been observed that it is desirable to reduce the amount of an infrared absorbent in a flash fixing color toner as small as possible.

Japanese Laid-Open Patent Application No.9-179347 discloses the inclusion of a small amount of carbon in a flash fixing color toner. Japanese Laid-Open Patent Application No.9-329912 discloses the inclusion of a small amount of coloring dyes or pigments in a flash fixing color toner. These measures are taken in the above documents to convert the color toner into a substantially black toner by inclusion of the secondary substances in order to improve the light energy absorption properties of such color toners and increase the efficiency of the color toner fixation to the recording medium.

Although the efficiency of the toner fixation in the cases of the above documents is increased to a certain extent, the substantially black toner, derived by the inclusion of the secondary substances, is liable to affecting the resulting color image, and the quality of the resulting color image, in particular, the sharpness, is low.

SUMMARY OF THE INVENTION

It is an object of the present invention to provide an improved flash fixing color toner in which the above-described problems are eliminated.

Another object of the present invention is to provide a flash fixing color toner that increases both the efficiency of the toner fixation and the sharpness of a resulting color image by using a hue-altering coloring agent having such characteristics that adequate light energy absorption properties are retained with the initial hue of the color toner prior to the irradiation of flash light and that the initial hue of the color toner is altered at the time of the irradiation of flash light into the secondary hue, the secondary hue providing adequate sharpness of the resulting color image.

Another object of the present invention is to provide an image forming process that increases both the efficiency of the toner fixation and the sharpness of a resulting color image by using a flash fixing color toner containing a hue-altering coloring agent having such characteristics.

The above-mentioned objects of the present invention are achieved by a flash fixing color toner for use in an image forming process, the color toner comprising a binder resin and a hue-altering coloring agent, wherein the hue-altering coloring agent alters, at a time of irradiation of flash light, an initial hue of the color toner into a secondary hue, so that the color toner is fixed to a recording medium by the irradiation of flash light, and a color image is substantially formed with the secondary hue of the color toner.

The above-mentioned objects of the present invention are achieved by an image forming process, which is characterized by using a flash fixing color toner, the color toner comprising a binder resin and a hue-altering coloring agent, the image forming process comprising the steps of: producing a toner image on a photoconductor by using the color toner; transferring the toner image from the photoconductor to a recording medium; and fixing the color toner to the recording medium by irradiation of flash light, so that a color image is formed on the recording medium, wherein the hue-altering coloring agent alters, at a time of the irradiation of flash light, an initial hue of the color toner into a secondary hue, so that the color toner is fixed to the recording medium by the irradiation of flash light, and the color image is substantially formed with the secondary hue of the color toner.

In the flash fixing color toner of the present invention, the hue-altering coloring agent alters the initial hue of the color toner at the time of irradiation of flash light into the secondary hue of the color toner after the toner is fixed to a recording medium by the irradiation of flash light. According to one preferred embodiment of the color toner of the present invention, the hue-altering coloring agent has the initial hue of the color toner prior to the irradiation of flash light, the initial hue being black, dark brown, brown or dark violet and providing adequate light energy absorbing properties. The hue-altering coloring agent has the secondary hue of the color toner after the toner is fixed to the recording medium by the irradiation of flash light, the secondary hue being yellow, reddish yellow, red, blue or green and providing adequate sharpness of a resulting color image to avoid the deterioration of the hue of the color image.

Accordingly, the flash fixing color toner of the present invention using the hue-altering coloring agent is effective in increasing both the efficiency of the toner fixation and the sharpness of the resulting color image.

Other objects, features and advantages of the present invention will become apparent from the following detailed description when read in conjunction with the accompanying drawing.

DETAILED DESCRIPTION OF PREFERRED EMBODIMENTS

Figure 1:
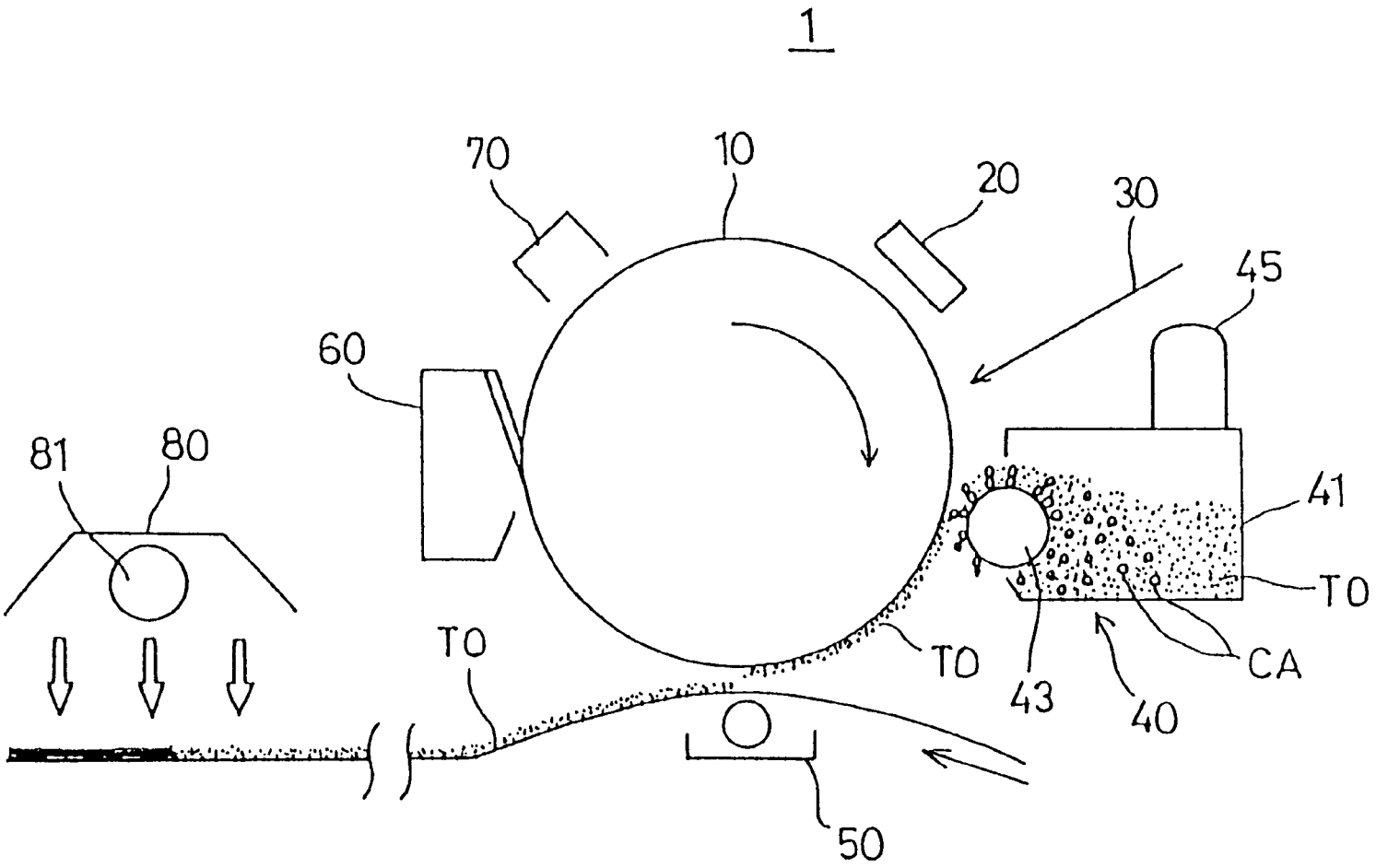
FIG. 1 is a schematic diagram of an image forming apparatus which uses a two-component developing agent.

A description will now be provided of the preferred embodiments of the present invention with reference to the accompanying drawing and working examples.

The present inventors have studied some solutions to the problem of a defective fixing in a flash fixing color toner used in an electrophotographic image forming process. The present inventors have found that a hue-altering coloring agent having such characteristics that alter the hue of the color toner from an initial hue prior to the irradiation of flash light into a secondary hue after the irradiation of flash toner can be suitably used to increase both the efficiency of the toner fixation and the sharpness of a resulting color image. It has been concluded that the hue-altering coloring agent in the flash fixing color toner according to the present invention is effective in reducing the deterioration of the hue of the color image and improving the light energy absorption properties of the toner.

In the flash fixing color toner according to the present invention, the hue-altering coloring agent alters the initial hue of the color toner at the time of irradiation of flash light into the secondary hue of the color toner after the toner is fixed to a recording medium by the irradiation of flash light. According to one preferred embodiment of the color toner of the present invention, the hue-altering coloring agent has the initial hue of the color toner prior to the irradiation of flash light, which is preferably a selected one of black, dark brown, brown and dark violet that has improved light energy absorbing properties. The hue-altering coloring agent has the secondary hue of the color toner after the toner is fixed to the recording medium by the irradiation of flash light, which is preferably a selected one of yellow, reddish yellow, red, blue and green that suitably provides the sharpness of a resulting color image and reduces the deterioration of the hue of the color image.

The flash fixing color toner according to the present invention essentially contains major components: a binder resin and a hue-altering coloring agent. The use of the hue-altering coloring agent in the flash fixing color toner according to the present invention is effective in increasing the efficiency of the toner fixation by holding the improved light energy absorption properties with the initial hue of the color toner at the time of irradiation of flash light, as well as in increasing the sharpness of a resulting color image with the secondary hue of the color toner after the toner is fixed to the recording medium.

Similar to the conventional color toner, in the flash fixing color toner of the present invention, a constant-hue colorant (e.g., a dye or pigment), a fixing control agent (e.g., a wax), a charge control agent, a flowability control agent (e.g., inorganic substances) may be contained additionally, if necessary.

When the constant-hue colorant is additionally contained, the secondary hue of the color toner derived by the hue-altering coloring agent has to be faint so as not to affect the hue of the constant-hue colorant or has to be similar to the hue of the constant-hue colorant. By using such hue-altering coloring agent, it is possible to increase the sharpness of the resulting color image.

The mechanism of structural changes of the hue-altering coloring agent that can be used by the flash fixing color toner of the present invention varies depending on individual examples of the hue-altering coloring agent.

According to the studies conducted by the present inventors, it is found that a metal complex of hydroxy azo compounds, which is an example of the hue-altering coloring agent of the invention, shows the desired characteristics. In the case of the metal complex of the hydroxy azo compounds, the hue-altering coloring agent provides an initial hue of the color toner, prior to the irradiation of flash light, which is black or dark violet. It is estimated that, after the toner is fixed to the recording medium by the irradiation of flash light, the metal complex is decomposed and fragments of the hydroxy azo compounds are produced by the irradiation of flash light, and the hue-altering coloring agent in this case provides a secondary hue of the color toner which is yellow or red.

In the above-mentioned hue-altering coloring agent, a composition of the hydroxy azo compound is represented by the following formula (1), and a composition of the metal complex is represented by the following formula (2):

(1)

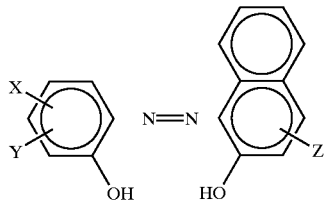

(2)

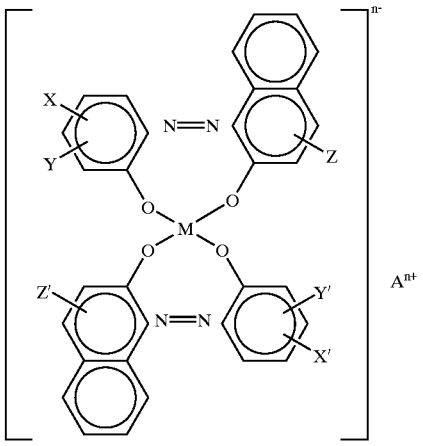

wherein X, X', Y and Y' represent hydrogen, a halogen, an alkylsulfone, a nitrile, an aminosulfone, an alkyl, a phenyl, a phenylamid or an alkylated phenylamid; Z and Z' represent hydrogen, a halogen, an alkylsulfone, an alkylated phenylamid, a halogenated phenylamid, a nitrated phenylamid or an alkyl etherificated phenylamid; M represents copper, iron, chromium, cobalt or nickel; and A represents a hydrogen ion, an alkali metal ion, an alkaline earth metal ion, an aliphatic ammonium ion or an alicyclic ammonium ion.

According to the studies conducted by the present inventors, it is found that the hydroxy azo compounds of the above type, having a maximum absorption wavelength in the range of 400 nm to 550 nm, show the desired characteristics.

All the hue-altering coloring agent contained in the color toner of the present invention does not provide the secondary hue of the color toner by the irradiation of flash light, and a certain amount of the hue-altering coloring agent is likely to remain unchanged. However, the secondary hue (changed from the initial hue) in the upper layer of the toner is more perceptible than in the lower layer thereof, and the secondary hue in the upper layer of the toner becomes dominant.

According to the studies conducted by the present inventors, practical examples of the flash fixing color toner of the invention are of the type containing the binder resin, the constant-hue colorant and a small amount of the hue-altering coloring agent. It is confirmed that, when producing a red toner as the flash fixing color toner, the type containing the red-based constant-hue colorant and the hue-altering coloring agent providing the secondary hue of light yellow as a result of the irradiation of flash light shows excellent characteristics.

The flash fixing color toner of the present invention may contain a plurality of hue-altering coloring agents in the presence of the constant-hue colorant, and the hue-altering coloring agents in such a case provide several secondary hues as a result of the irradiation of flash light. It is necessary that the secondary hues derived by the hue-altering coloring agents are faint and light so as not to affect the hue of the constant-hue colorant. By suitably controlling the secondary hues of the hue-altering coloring agents in comparison with the hue of the constant-hue colorant, it is possible to provide the sharpness of the resulting color image while avoiding the deterioration of the hue of the color image.

The content of the hue-altering coloring agent in the flash fixing color toner of the present invention has to be in the range of 0.01% to 0.1% by weight, and preferably in the range of 0.03% to 0.1% by weight. If the content of the hue-altering coloring agent in the color toner is larger than 0.1% by weight, the influence of the amount of the hue-altering coloring agent with the initial hue unchanged will not be negligible. If the content of the hue-altering coloring agent in the color toner is less than 0.01% by weight, the desired effects of the hue-altering coloring agent will be inadequate. Preferably, the flash fixing color toner of the present invention contains the hue-altering coloring agent in the range of 0.05% to 0.08% by weight.

When a color toner containing a blue or green colorant as the constant-hue colorant is produced, the color toner in such a case may have a light absorbing property that is provided by a combination of the constant-hue colorant and the hue-altering coloring agent. However, when producing a red-based color toner, it is desirable that the color toner in such a case contains a very small amount of an infrared absorbent. It is necessary that the content of the infrared absorbent in the color toner of the present invention is rather smaller than that of the conventional color toner.

Examples of the infrared absorbent which may be contained in the color toner of the present invention include a component or a combination of components selected from a group including an aminuim salt, a diimmonium salt, phthalocyanine, naphthalocyanine, a cyanine colorant, a polymethine colorant, a nickelthiol complex colorant, a lanthanoids compound and a tin oxide. These examples are known as having good infrared absorbing properties.

Any binder resin may be suitably contained in the flash fixing color toner of the present invention if it is a thermoplastic resin. It is preferable that a polyester resin is contained as a major component of the binder resin for use in the flash fixing color toner of the present invention because the odor does not occur when fixing the color toner containing it as the major component of the binder resin. An epoxy resin, a styrene acryl resin or a polyether-polyol resin may be contained in the flash fixing color toner of the present invention in addition to the polyester resin. When necessity arises, a polyethylene wax, a polypropylene wax, a low-molecule ester wax, a paraffin wax, an amid compound wax or a carnauba wax may be contained in the flash fixing color toner of the present invention in addition to the polyester resin, similar to a general-purpose color toner.

Examples of the above polyester resin that is contained as the binder resin in the color toner of the present invention are known from Japanese Laid-Open Patent Application No.62-291668 or U.S. Pat. No. 4,804,622. For example, the alcohol component of the polyester resin mentioned above may be a bisphenol A with ethylene or propylene oxide additives, and the acid component of the binder resin may be terephtalic acid. Further, a bridge forming agent, such as a trimeric acid, may be used. It is preferable that the polyester resin as the major component of the binder resin has a glass transition point of 60 deg. C. or above. When it is used as the toner, it is preferable that the polyester resin has a glass transition point of 58 deg. C. or above. This property of the polyester resin is needed to avoid hardening during transport or the like.

It is preferable that the alcohol component of the polyester resin includes 80 mol % or more of bisphenol-A alkylene oxide additives, and more preferably 95% or more of bisphenol-A alkylene oxide additives. If the content of the alcohol component is less than 80 mol %, the amount of monomers used becomes relatively large, which will cause the occurrence of the odor when fixing the toner.

Examples of the alcohol component of the above polyester resin include polyoxypropylene-(2.2)-2,2-bis(4-hydroxyphenyl)propane, polyoxypropylene(3.3)-2,2-bis(4-hydroxyphenyl)propane, polyoxyethylene(2.0)-2,2-bis(4-hydroxyphenyl)propane, polyoxyethylene(2.2)-2,2-bis(4-hydroxyphenyl)propane, polyoxypropylene(2.0)-polyoxyethylene(2.0)-2,2-bis(4-hydroxyphenyl)propane, and polyoxypropylene(6)-2,2-bis(4-hydroxyphenyl) propane.

The alcohol component may include ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, polytetramethylene glycol, bisphenol-A and hydrogenated bisphenol-A.

The tri- or poly-functional alcohol component may be contained to reduce offset. Examples of such alcohol component include sorbitol, 1,23,6-hexanetetrol, 1,4-sorbitan, pentaerythritol, dipentaerythritol, tripentaerithritol, 1,2,4-butanetriol, 1,2,5-pentanetriol, glycerol, 2-methypropanetriol, 2-methyl-1,2,4-butanetriol, trimethylolethane, trimethylolpropane, 1,3,5-trihydroxymethylbenzene, and other tri- and poly-hydroxylic alcohols.

Examples of the acid component of the above polyester resin include maleic acid, furamric acid, citraconic acid, itaconic acid, glutaric acid, phthalic acid, isophthalic acid, terephthalic acid, cyclohexanedicarboxylic acid, succinic acid, adipic acid, sebacic acid, azelaic acid, malonic acid, an anhydride thereof, a lower alkyl ester thereof and other dibasic carboxylic acids. Examples of the tri- and poly-basic carboxylic acid component include 1,2,4-benzene-tricarboxylic acid, 1,3,5-benzene-tricarboxylic acid, and other poly-basic carboxylic acids or anhydrides thereof. Further, in order to accelerate formation of the above polyester resin, an esterification catalyst, such as zinc oxide, stannous oxide, dibutyl-tin-oxide or dibutyl-tin-dilaurate may be used.

A commonly used colorant may be used as the constant-hue colorant in the flash fixing color toner of the present invention. Examples of the constant-hue colorant that may be contained in the color toner of the present invention include aniline blue (C.I. No.50405), chalco oil blue (C.I. No. azoic blue3), chrome yellow (C.I. No.77103), ultramarine blue (C.I. No.77103), DUPONT oil red (C.I. No.26105), quinoline yellow (C.I. No.47005), methylene blue chloride (C.I. No.52015), phthalocyanine blue (C.I. No.74160), halogenated phthalocyanine blue (C.I. No.74265/C.I. No.74255), malachite green oxalate (C.I. No.42000), lamp black (C.I. No.77266), rose bengal (C.I. No.45435), ECR-181 (Pg. No.122) and a mixture of these colorants.

In the flash fixing color toner of the present invention, the content of the above constant-hue colorant is normally in the range of 0.1 to 20 parts by weight, based on 100 parts by weight of the color toner. It is preferable that the content of the above constant-hue colorant in the flash fixing color toner of the present invention is in the range of 0.5 to 10 parts by weight.

In the flash fixing color toner of the present invention, the flowability control agent, such as inorganic substance particles, may be contained additionally. The content of the flowability control agent in the color toner of the present invention is normally in the range of 0.01 to 5 parts by weight. It is preferable that the content of the flowability control agent in the color toner is in the range of 0.01 to 2.0 parts by weight. Examples of the flowability control agent include fine particles of silica, alumina, titanium oxide, barium titanate, magnesium titanate, calcium titanate, strontium titanate, zinc oxide, silica sand, clay, mica, silicide, diatom earth, chromium oxide, cerium oxide, iron oxide, antimony trioxide, magnesium oxide, zirconium oxide, barium sulfate, barium carbonate, calcium carbonate, silicon carbide, silicon nitride, and the like. In particular, fine particles of silica or titanium oxide are more suitable for the above flowability control agent.

In the flash fixing color toner of the present invention, the fixing control agent, such as a wax, may be contained additionally. The content of the fixing control agent in the color toner of the present invention is normally in the range of 0.05 to 5 parts by weight. It is preferable that the content of the fixing control agent in the color toner is in the range of 0.2 to 2.0 parts by weight. Examples of the fixing control agent include a polyethylene wax, a polypropylene wax, a low-molecule ester wax, a paraffin wax, a carnauba wax, and the like.

The flash fixing color toner of the present invention can be produced by using known toner production processes. More specifically, the binder resin and the hue-altering coloring agent, optically with the constant-hue colorant (dye or pigment), the infrared absorbent, the charge control agent, the fixing control agent (wax) are mixed, melted and uniformly dispersed by means of a mixer, a compression kneader, a roll mill or an extruder. Then, the dispersed mixture is finely divided by a pulverizer or a jet mill. If necessary, the fine particles of inorganic substances are added to the pulverized mixture. The pulverized product is classified by an air classifier to obtain the flash fixing color toner.

The flash fixing color toner of the present invention may be provided as a one-component developing agent without the carrier. Alternatively, the flash fixing color toner of the present invention may be provided as a two-component developing agent by adding the carrier to the color toner. When the flash fixing color toner of the present invention is used as the two-component developing agent, it is preferable that a resin-coat ferrite carrier or an iron power carrier is added to the color toner.

When the ferrite carrier is used in the case of the two-component developing agent, it is preferable that it contains at least manganese and the magnetization is in the range of 75 to 100 emu/g at 10 kOe. It is preferable that the content of the resin coat in the ferrite carrier is in the range of 0.5% to 3% by weight based on 100% by weight of the carrier core. Examples of the resin coat include silicon, an acrylic resin, a styrene resin and an urethane resin. The average particle size of the carrier core material is normally in the range of 30μm to 100 μm. It is preferable that the average particle size of the carrier core material is in the range of 60 μm to 90 μm. If the average particle size is less than 20 μm, the magnetization per carrier particle will be inadequate, and the scattering of the carrier will not be negligible. If the average particle size is larger than 100 μm, the specific surface area of the carrier will be inadequate, and the scattering of the toner will not be negligible. Examples of the solvent, used to form a layer of the carrier coating resin, include toluene, xylene, methyl ethyl ketone, methyl isobutyl ketone, and cellusolbutyl acetate, When forming the layer of the coating resin on the carrier core, the coating resin is dissolved in the solvent. The dissolved coating resin liquid is uniformly applied to the carrier core material by means of a dipping method, a spraying method or a brushing method. After drying, the solvent is removed and the layer of the coating resin is formed on the carrier core. If necessary, a baking process may be performed. The baking device used for the baking process may be either an external heating type or an internal heating type. Examples of the baking device include a fixed or movable electric furnace, a rotary electric furnace, a burner furnace, and a microwave oven. The baking temperature in the above baking process is normally in the range of 180 deg. C. to 300 deg. C. It is preferable that the baking temperature is in the range of 220 deg. C. to 280 deg. C. If the baking temperature is below 180 deg. C., the hardening of the coating resin will be inadequate. If the baking temperature is above 300 deg. C., the decomposition of the coating resin will not be negligible, and the surface roughness of the coating resin layer will be detrimental to the color toner.

As described above, the flash fixing method can be performed, as one of the major steps of the electrophotographic image forming process, by using the flash fixing color toner of the present invention. In the flash fixing method, the color toner of the present invention is fixed to the recording medium by irradiation with flash light, so that a color image is created on the recording medium. The flash light irradiation energy, used in the fixing step, is in the range of 0.5 J/cm$^2$ to 3.0 j/cm$^2$, and the flash light irradiation period, used in the fixing step, is in the range of 500 μs to 3000 μs.

A description will be given of an image forming apparatus which carries out the electrophotographic image forming process by using the flash fixing color toner of the present invention.

FIG. 1 shows an image forming apparatus 1 which uses a two-component developing agent. The image forming apparatus 1 is configured with a high-speed developing capability (which has, for example, the process speed 1152 mm/s).

As shown in FIG. 1, in the image forming apparatus 1, a photoconductor 10 is provided, and the photoconductor 10 is made of amorphous silicon. A charger 20, a developing device 40, a transferring device 50, a cleaner 60, a charge removing device 70, and a flash fixing device 80 are arranged along the periphery of the photoconductor 10.

The charger 20 electrostatically charges the photoconductor 10. The photoconductor 10 is rotated in the direction indicated by the arrow in FIG. 1. The charged surface of the photoconductor 10 is exposed to an imaging light pattern 30 supplied by an exposure device (not shown), and an electrostatic latent image is created on the surface of the photoconductor 10. The developing device 40 develops the photoconductor 10 by bringing charged toner particles to the surface of the photoconductor 10 to create a toner image on the photoconductor surface. In the image forming apparatus 1, a recording medium (e.g., paper) is transported to the portion of the photoconductor 10 where the transferring device 50 is provided. The transferring device 50 transfers the toner image from the photoconductor surface to the recording medium. After the image transferring is performed, the recording medium is transported to the flash fixing device 80. The cleaner 60 cleans residual toner from the surface of the photoconductor 10, and the charge removing device 70 removes the charge from the surface of the photoconductor 10 so as to allow reinitiation of the above steps of the electrophotographic image forming process.

The flash fixing device 80 includes a xenon flash lamp 81. In the flash fixing device 80, the recording medium carrying the toner image is irradiated with flash light from the xenon flash lamp 81, so that the color toner is fixed to the recording medium.

The developing device 40 generally includes a developing agent container 41, a developing roller 43, stirring blades (not shown), and a developing agent supply portion 45. The two-component developing agent is supplied into the container 41 from the supply portion 45. In the developing agent container 41, the toner particles TO and the carrier particles CA are brought into contact with each other and a given quantity of charge is supplied to the toner. The two-component developing agent may use the previously described carrier as the carrier component and the flash fixing color toner of the present invention as the toner component.

By carrying out the electrophotographic image forming process using the flash fixing color toner of the present invention in the image forming apparatus 1 described above, it is possible to provide increased efficiency of the toner fixation and increased sharpness of a resulting color image.

The present invention will now be described in detail with reference to the following examples of the flash fixing color toner. The following examples are not intended to limit the scope of the present invention. The following examples are of the type that contains the binder resin, the hue-altering coloring agent and the constant-hue colorant.

EXAMPLES 1, 4, 5 (EX.1, EX.4, EX.5)

The binder resin in these examples is prepared from a polyester resin containing polyoxypropylene(2.2)-2,2-bis(4-hydroxyphenyl)propane, polyoxyethylene(2.2)-2,2-bis(4-hydroxyphenyl)propane, 1,2-propylene glycol, a terephthalic acid, an isophthalic acid and a trimeric acid. The wax (the fixing control agent) is a polypropylene wax ("Viscol 550P" made by Sanyo Kasei K. K.). The constant-hue colorant (red) is the C.I. Pigment Red 60. The infrared absorbent is an aminium perchloric acid salt ("NIR-1600" made by Teikoku Kagaku K. K.). The charge control agent is a calixarene compound ("E-89" made by Orient Kagaku K. K.).

The hue-altering coloring agent in these examples has the composition of the hydroxy azo compound represented by the above formula (1) and the composition of the metal complex represented by the above formula (2) wherein X and X' represent nitro ($NO_2$), Y and Y' represent chlorine (Cl), Z and Z' represent hydrogen (H), M represents chromium (Cr), and A represents hydrogen (H). The maximum absorption wavelength is 550 nm. The initial hue provided by the hue-altering coloring agent prior to the irradiation of flash light is black, and the secondary hue provided by the hue-altering coloring agent after the toner is fixed to the recording medium is pink.

The composition of the source materials of the toner in these examples is shown in TABLE 1 below. The known toner production processes are performed. The source materials of the toner, which are weighed in accordance with the composition shown in TABLE 1, are mixed by using a mixer. Then, the mixture is melted and uniformly dispersed by using an extruder. The dispersed mixture is finely divided and classified by means of a jet mill and an air classifier to obtain the base of the flash fixing color toner. Finally, 0.5% by weight of fine particles of hydrophobic silica (inorganic substances) is added to the toner base, and they are mixed by using a mixer. The flash fixing color toner in these examples is thus obtained.

EXAMPLE 2 (EX.2)

The toner in this example is essentially the same as the toner in the above Examples 1, 4 and 5, except that the hue-altering coloring agent in this example has the composition of the hydroxy azo compound and the composition of the metal complex represented by the above formulas (1) and (2) wherein X and X' represent hydrogen (H), Y and Y' represent chlorine (Cl), Z and Z' represent $CONHC_6H_5$, M represents iron (Fe), and A represents $NH_4$, and the maximum absorption wavelength is 520 nm. In this example, the initial hue provided by the hue-altering coloring agent is black, and the secondary hue provided by the hue-altering coloring agent is orange.

EXAMPLE 3 (EX.3)

The toner in this example is essentially the same as the toner in the above Example 2, except that the constant-hue colorant (green) is the C.I. Pigment Green 36.

COMPARATIVE EXAMPLE 1 (C/EX.1)

The toner in this example is essentially the same as the toner in the above Example 1, except that this example does not contain the metal complex of the hydroxy azo compounds in the Example 1.

COMPARATIVE EXAMPLE 2 (C/EX.2)

The toner in this example is essentially the same as the toner in the above Comparative Example 1, except that the content of the infrared absorbent in this example is different from that of the Comparative Example 1.

COMPARATIVE EXAMPLE 3 (C/EX.3)

The toner in this example is essentially the same as the toner in the above Example 1, except that the content of the metal complex of the hue-altering coloring agent in this example is different from that of the Example 1.

COMPARATIVE EXAMPLE 4 (C/EX.4)

The toner in this example is essentially the same as the toner in the above Example 1, except that the content of the metal complex of the hue-altering coloring agent in this example is different from that of the Example 1.

COMPARATIVE EXAMPLE 5 (C/EX.5)

The toner in this example is essentially the same as the toner in the above Example 3, except that this example does not contain the metal complex of the hydroxy azo compounds in the Example 3.

The image forming process is performed by using the respective toners of the above examples and comparative examples. The method of evaluation of a resulting color image and the results of the evaluation will now be described in detail.

The respective toners of the above examples and comparative examples are provided as a two-component developing agent, and the carrier contained in each developing agent is MMA resin-coat magnesium-ferrite carrier (made by PowderTec K.K.).

Before performing the evaluation of a resulting color image with respect to each of the respective toners, 95.5% by weight of the carrier and 4.5% by weight of the toner are mixed to obtain the developing agent. The developing agent is incorporated into a flash fixation printer ("F6768W" made by Fujitsu Limited), and the electrophotographic printing process, including the toner flash fixing step, is carried out with the printer and the developing agent. Then, the toner fixing degree and the hue of a resulting color image on the recording medium are evaluated.

The rating of evaluation of the toner fixing degree is made as follows. A peel-off test is conducted for the resulting color image on the recording medium by using a mending tape (made by 3M K.K.). The tape is attached to the recording medium carrying the image by applying the load of 600 g, and the tape is peeled from the recording medium. The optical density of the residual image on the tape after the separation from the recording medium is measured by using a reflection densitometer. The toner fixing degree is determined for each example by obtaining a ratio of the optical density after the tape separation to the optical density before the tape separation. When the toner fixing degree is above 90%, the rating of evaluation of the example is very good (indicated by "A" in TABLE 2). When the toner fixing degree is above 80%, the rating of evaluation of the example is good (indicated by "B" in TABLE 2). When the toner fixing degree is less than 80%, the rating of evaluation of the example is poor (indicated by "C" in TABLE 2).

The rating of evaluation of the color image hue is made as follows. An organoleptic test is conducted for the resulting color image on the recording medium. When the color image hue is evaluated as being very sharp, the rating of evaluation of the example is very good (indicated by "A" in TABLE 2). When the color image hue is evaluated as being sharp, the rating of evaluation of the example is good (indicated by "B" in TABLE 2). When the color image hue is evaluated as being blunt, the rating of evaluation of the example is poor (indicated by "C" in TABLE 2).

TABLE 1

Composition of Source Materials of Toner (in weight %)

| | EX. 1 | EX. 2 | EX. 3 | EX. 4 | EX. 5 |
|---|---|---|---|---|---|
| Binder Resin | 91.950 | 91.950 | 93.220 | 93.250 | 93.250 |
| C/Hue Colorant | 5.0 | 5.0 | 4.0 | 4.0 | 4.0 |
| Fixing/C Agent | 1.0 | 1.0 | 1.0 | 1.0 | 1.0 |
| Infrared Absorbent | 1.0 | 1.0 | 0.75 | 0.75 | 0.75 |
| Charge/C Agent | 1.0 | 1.0 | 1.0 | 1.0 | 1.0 |
| Hue/Alt. C/Agent | 0.05 | 0.05 | 0.05 | 0.01 | 0.1 |
| Inorganic Substance | 0.5 | 0.5 | 0.5 | 0.5 | 0.5 |
| | C/EX. 1 | C/EX. 2 | C/EX. 3 | C/EX. 4 | C/EX. 5 |

TABLE 1-continued

| Composition of Source Materials of Toner (in weight %) | | | | | |
|---|---|---|---|---|---|
| Binder Resin | 92.000 | 91.000 | 91.850 | 91.995 | 93.250 |
| C/Hue Colorant | 5.0 | 5.0 | 5.0 | 5.0 | 4.0 |
| Fixing/C Agent | 1.0 | 1.0 | 1.0 | 1.0 | 1.0 |
| Infrared Absorbent | 1.0 | 2.0 | 1.0 | 1.0 | 0.75 |
| Charge/C Agent | 1.0 | 1.0 | 1.0 | 1.0 | 1.0 |
| Hue/Alt. C/Agent | none | none | 0.15 | 0.005 | none |
| Inorganic Substance | 0.5 | 0.5 | 0.5 | 0.5 | 0.5 |

The total of the source materials of each toner in which the carrier is removed is 100 parts by weight.

TABLE 2

| Results of Evaluation of Toner | | | | | |
|---|---|---|---|---|---|
| | EX. 1 | EX. 2 | EX. 3 | EX. 4 | EX. 5 |
| Toner Fixing Degree | A (90%) | B (85%) | A (90%) | B (80%) | A (90%) |
| Color Image | B sharp | A sharp | B sharp | A sharp | A |
| Hue | red | red | green | red | red |
| | C/EX. 1 | C/EX. 2 | C/EX. 3 | C/EX. 4 | C/EX. 5 |
| Toner Fixing Degree | C (50%) | B (80%) | A (95%) | C (65%) | C (70%) |
| Color Image | A sharp | C reddish | C reddish | A sharp | A sharp |
| Hue | red | brown | violet | red | green |

As is apparent from Table 2, the color toners of Examples 1 to 5, which contain the hue altering coloring agent in the range of 0.05% to 0.1% by weight, show the desired toner fixing characteristics, and the content of the infrared absorbent in each toner is maintained at low level. It is confirmed that the color toners of Examples 1, 4 and 5, containing the hue-altering coloring agent having the secondary hue that is pink, and the constant-hue colorant that is red, present adequate sharpness of the color image hue by cooperation of the hue-altering coloring agent and the constant hue colorant. It is confirmed that the color toner of Example 2, containing the hue-altering coloring agent having the secondary hue that is orange, and the constant-hue colorant that is red, shows adequate sharpness of the color image hue by cooperation of the hue-altering coloring agent and constant-hue colorant.

Further, it is confirmed that the color toner of Example 3, containing the hue-altering coloring agent having the secondary hue that is orange, and the constant-hue colorant that is green, shows adequate sharpness of the color image hue by cooperation of the hue-altering coloring agent and the constant-hue colorant.

Moreover, it is confirmed that the color toner of Comparative Example 1, which does not contain the hue-altering coloring agent as in Example 1, shows a significantly low toner fixing degree. The color toner of Comparative Example 2 has the content of the infrared absorbent in this example that is increased to 2.0% from the level of Comparative Example 1. It is confirmed that the color toner of Comparative Example 2 shows improvement of the toner fixing degree due to the increased content of the infrared absorbent. However, the hue of the color image provided by the color toner of Comparative Example 2 becomes poor due to the increased content of the infrared absorbent.

Further, it is confirmed that the color toner of Comparative Example 4, which contains 0.005% by weight of the hue-altering coloring agent, still shows a low toner fixing degree, but the toner fixing degree is increased from 50% in the toner of Comparative Example 1 to 60% in the toner of Comparative Example 4. The color toner of Example 4 contains 0.01% by weight of the hue-altering coloring agent and shows good toner fixing characteristics that appear to be the permissible lower limit.

The color toner of Example 5 contains 0.1% by weight of the hue-altering coloring agent and shows very good toner fixing characteristics that appear to be the permissible upper limit. When the content of the hue-altering coloring agent in the toner is larger than 0.15% by weight, the sharpness of the resulting color image deteriorates gradually, and the desired sharpness will not be obtained. The influence of a certain amount of the hue-altering coloring agent with the initial hue unchanged after the irradiation of flash light will not be negligible. It is estimated that mismatch between the initial hue provided by the amount of the hue-altering coloring agent and the hue provided by the constant-hue colorant is the major cause of the deterioration of the sharpness.

Further, the color toner (green) of Comparative Example 5 is essentially the same as the color toner of Example 3, except that this example does not contain the metal complex of the hydroxy azo compounds in the Example 3. It is confirmed that the toner of Comparative Example 5 shows a significantly low toner fixing degree.

The present invention is not limited to the above-described embodiments, and variations and modifications may be made without departing from the scope of the present invention.

As described in the foregoing, in the flash fixing color toner of the present invention, the hue-altering coloring agent alters, at the time of irradiation of flash light, the initial hue of the color toner into the secondary hue due to the thermal and optical energy absorbed by the toner. The initial hue of the color toner prior to the irradiation of flash light is any of black, dirk brown, brown or dirk violet and provides adequate light energy absorbing properties. The secondary hue of the color toner after the toner is fixed to the recording medium by the irradiation of flash light is any of yellow, reddish yellow, red, blue or green and provides adequate sharpness of a resulting color image to avoid the deterioration of the hue of the color image. Accordingly, the flash fixing color toner of the present invention using the hue-altering coloring agent is effective in increasing both the efficiency of the toner fixation and the sharpness of the resulting color image.

Further, the present invention is based on Japanese priority application No.2000-379343, filed on Dec. 13, 2000, the entire contents of which are hereby incorporated by reference.

What is claimed is:

1. A flash fixing color toner for use in an image forming process, the color toner comprising a binder resin and a hue-altering coloring agent, wherein the hue-altering coloring agent alters, at a time of irradiation of flash light, an initial hue of the color toner into a secondary hue, so that the color toner is fixed to a recording medium by the irradiation of flash light, and a color image is substantially formed with the secondary hue of the color toner;

wherein the color toner contains the hue-altering coloring agent in a range of 0.01% to 0.1% by weight.

2. The color toner as claimed in claim 1, further comprising a constant-hue colorant.

3. The color toner as claimed in claim 2, further comprising an infrared absorbent.

4. The color toner as claimed in claim 3 wherein the infrared absorbent is a compound or a combination of compounds selected from the group consisting of an aminium salt, a diimmonium salt, phthalocyanine, naphthalocyanine, cyanine colorant, a lanthanoids compound and a tin oxide.

5. A flash fixing color toner for use in an image forming process, the color toner comprising a binder resin and a hue-altering coloring agent, wherein the hue-altering coloring agent alters, at a time of irradiation of flashlight, an initial hue of the color toner into a secondary hue, so that the color toner is fixed to a recording medium by the irradiation of flash light, and a color image is substantially formed with the secondary hue of the color toner, wherein the hue-altering coloring agent is provided to have the initial hue that is black, brown or dark violet and provides adequate light energy absorbing properties, and to have the secondary hue that substantially constitutes a component color of the resulting color image, further wherein the hue-altering coloring agent comprises a metal complex of hydroxy azo compounds, and further wherein the color toner contains the hue-altering agent in a range of 0.01% to 0.1% by weight.

6. An image forming process, which is characterized by using a flash fixing color toner, the color toner comprising a binder resin and a hue-altering coloring agent, the image forming process comprising the steps of:

producing a toner image on a photoconductor by using the color toner;

transferring the toner image from the photoconductor to a recording medium; and fixing the color toner to the recording medium by irradiation of flash light, so that a color image is formed on the recording medium, wherein the hue-altering coloring agent alters, at a time of the irradiation of flash light, an initial hue of the color toner into a secondary hue, so that the color toner is fixed to the recording medium by the irradiation of flash light, and the color image is substantially formed with the secondary hue of the color toner, wherein the hue-altering coloring agent is provided to have the initial hue that is black, brown or dark violet and provides adequate light energy absorbing properties, and to have the secondary hue that substantially constitutes a component color of the resulting color image, and wherein the hue-altering coloring agent comprises a metal complex of hydroxy azo compounds.

7. The image forming process as claimed in claim 6, wherein the fixing step uses a flash light irradiation energy that is in the range of 0.5 J/cm$^2$ to 3.0 J/cm$^2$, and a flash light irradiation period that is in the range of 500 $\mu$s to 3000 $\mu$s.

8. A flash fixing color toner for use in an image forming process, the color toner comprising a binder resin and a hue-altering coloring agent, wherein the hue-altering coloring agent alters, at a time of irradiation of flash light, an initial hue of the color toner into a secondary hue, so that the color toner is fixed to a recording medium by the irradiation of flash light, and a color image is substantially formed with the secondary hue of the color toner;

wherein the hue-altering coloring agent is provided to have the initial hue that is black, brown or dark violet and provides adequate light energy absorbing properties, and to have the secondary hue that substantially constitutes a component color of the resulting color image;

further comprising a constant-hue colorant;

and further comprising an infrared absorbent.

9. A flash fixing color toner for use in an image forming process, the color toner comprising a binder resin and a hue-altering coloring agent, wherein the hue-altering coloring agent alters, at a time of irradiation of flash light, an initial hue of the color toner into a secondary hue, so that the color toner is fixed to a recording medium by the irradiation of flash light, and a color image is substantially formed with the secondary hue of the color toner;

wherein the hue-altering coloring agent is provided to have the initial hue that is black, brown or dark violet and provides adequate light energy absorbing properties, and to have the secondary hue that substantially constitutes a component color of the resulting color image;

further comprising a constant-hue colorant and an infrared absorbent;

wherein the infrared absorbent is a compound or a combination of compounds selected from the group consisting of an aminium salt, a diimmonium salt, phthalocyanine, naphthalocyanine, cyanine colorant, a lanthanoids compound and a tin oxide.

* * * * *